US008871051B2

(12) United States Patent
Rector et al.

(10) Patent No.: US 8,871,051 B2
(45) Date of Patent: Oct. 28, 2014

(54) PROCESS FOR DECOMPOSING LIGNIN IN BIOMASS

(75) Inventors: Kirk Davin Rector, Santa Cruz, NM (US); Marcel Lucas, Pullman, WA (US); Gregory Lawrence Wagner, Los Alamos, NM (US); David Bryan Kimball, Los Alamos, NM (US); Susan Kloek Hanson, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 13/426,420

(22) Filed: Mar. 21, 2012

(65) Prior Publication Data

US 2013/0248128 A1 Sep. 26, 2013

(51) Int. Cl.
*D21C 3/04* (2006.01)

(52) U.S. Cl.
USPC ..... 162/76

(58) Field of Classification Search
CPC ..... D21C 3/04
USPC ..... 162/76
See application file for complete search history.

(56) References Cited

U.S. PATENT DOCUMENTS

| | | | | |
|---|---|---|---|---|
| 2,394,989 | A * | 2/1946 | Bonard | 162/76 |
| 4,314,854 | A * | 2/1982 | Takagi | 127/37 |
| 5,630,906 | A * | 5/1997 | Boe et al. | 162/74 |
| 2001/0025695 | A1 | 10/2001 | Mielisch et al. | |

FOREIGN PATENT DOCUMENTS

| | | |
|---|---|---|
| FR | 2813896 | 3/2002 |
| WO | WO 0160752 | 8/2001 |
| WO | WO 0234926 | 5/2002 |
| WO | WO 2005040392 | 5/2005 |

OTHER PUBLICATIONS

Zakzeski et al., "Transition metal catalyzed oxidation of Alcell lignin, soda lignin, and lignin model compounds in ionic liquids," Green Chem., 2010, vol. 12, pp. 1225-1236.
Zinoviev et al., "Next-Generation Biofuels: Survey of Emerging Technologies and Sustainability Issues," ChemSusChem, Oct. 2010, vol. 3, pp. 1106-1133.
Zucca et al., "5,10,15,20-Tetrakis(4-sulfonato-phenyl)porphine-Mn(III) immobilized on imidazole-activated silica as a novel lignin-peroxidase-like biomimetic catalyst," J. Mol. Catal. A: Chem, 2007, vol. 278, pp. 220-227.
Agarwal et al., "FT-Raman Spectroscopy of Wood: Identifying Contributions of Lignin and Carbohydrate Polymers in the Spectrum of Black Spruce (Picea mariana)," Appl. Spectroscopy, Nov. 1997, vol. 51, pp. 1648-1655.
Arantes et al., "Biomimetic oxidative treatment of spruce wood studied by pyrolysis-molecular beam mass spectrometry coupled with multivariate analysis and 13C-labeled tetramethylammonium hydroxide thermochemolysis: implications for fungal degradation of wood," Journal of Biological Inorganic Chemistry, Nov. 2009, vol. 14, pp. 1253-1263.
Arunkumar et al., "Hydrogen-Atom Abstraction Reactions by Manganese(V)- and Manganese(IV)-Oxo Porphyrin Complexes in Aqueous Solution," Chemistry —A European Journal, Oct. 2009, vol. 15, pp. 11482-11489.
Agarwal et al., "Near-IR surface enhanced Raman spectrum of lignin," J. Raman Spectroscopy, May 2009, vol. 40, pp. 1527-1534.
Banci et al., "Lignin and Mn Peroxidase-Catalyzed Oxidation of Phenolic Lignin Oligomers," Biochemistry, Feb. 1999, vol. 38, pp. 3205-3210.
Barroso et al., "Chemistry and reactivity of mononuclear manganese oxamate complexes: Oxidative carbon-carbon cleavage of vic-diols by dioxygen and aldehydes catalyzed by a trans-dipyridine manganese(III) complex with a tetradentate o-phenylenedioxamate ligand," J. Molec. Catal. A, Jan. 2006, vol. 243, pp. 214-220.
Bodini et al., "Electrochemical and spectroscopic studies of nnanganese(II), -(III), and —(IV) gluconate complexes. 1. Formulas and oxidation-reduction stoichiometry," Inorg. Chem., Jul. 1976, vol. 15, pp. 1538-1543.
Bodini et al., "Electrochemical and spectroscopic studies of manganese(II), -(III), and —(IV) gluconate complexes. 2. Reactivity and equilibriums with molecular oxygen and hydrogen peroxide," J. Am. Chem. Soc., 1976, vol. 98, pp. 8366-8371.
Caudle et al., "Mechanism for the Homolytic Cleavage of Alkyl Hydroperoxides by the Manganese(III) Dimer MnIII2(2-OHsalpn)2," Inorg. Chem., 1996, vol. 35, pp. 3577-3584.
Chai et al., "Rapid determination of hydrogen peroxide in the wood pulp bleaching streams by a dual-wavelength spectroscopic method," Analytica Chimica Acta, Apr. 2004, vol. 507, pp. 281-284.
Cremonesi et al., "One-Electron Oxidation of 6-Substituted Benzo[a]pyrenes by Manganic Acetate. A Model for Metabolic Activation," J. Org. Chem., Feb. 1989, vol. 54, pp. 3561-3570.
Crestini et al., "Oxidative strategies in lignin chemistry: A New environmental friendly approach for the functionalization of lignin and lignocellulosic fibers," Catal. Today, 2010, vol. 156, pp. 8-22.
Crestini et al., "Metalloporphyrins immobilized on motmorillonite as biomimetic catalysts in the oxidation of lignin model compounds," J. Mol. Catal. A, 2004, vol. 208, pp. 195-202.
Cui et al., "A $Mn(IV)_4$ DTNE complex catalyzed oxidation of lignin model compounds with hydrogen peroxide," J. Mol. Catal. A, 1999, vol. 144, pp. 411-417.
Davies et al., "Kinetics and Stoichiometry of the reaction between manganese(III) and hydrogen peroxide in acid perchlorate solution," Inorg. Chem., 1968, vol. 7, pp. 146-154.
Davies et al., "Some aspects of the chemistry of manganese(III) in aqueous solution," Coord. Chem. Rev., 1969, vol. 4, pp. 199-224.

(Continued)

*Primary Examiner* — Jacob Thomas Minskey
(74) *Attorney, Agent, or Firm* — Samuel L. Borkowsky

(57) ABSTRACT

A mild inexpensive process for treating lignocellulosic biomass involves oxidative delignification of wood using an aqueous solution prepared by dissolving a catalytic amount of manganese (III) acetate into water and adding hydrogen peroxide. Within 4 days and without agitation, the solution was used to convert poplar wood sections into a fine powder-like delignified, cellulose rich materials that included individual wood cells.

12 Claims, No Drawings

(56) References Cited

OTHER PUBLICATIONS

Eronen et al., "Effect of alkaline treatment on cellulose supramolecular structure studied with combined confocal Raman spectroscopy and atomic force microscopy," Cellulose, Apr. 2009, vol. 16, pp. 167-178.
Forrester et al., "Manganese, Mn-dependent peroxidases, and biodegradation of lignin," Biochem. Biophys. Res. Comm. Dec. 1988, vol. 157, pp. 992-999.
Gilbert et al., "EPR evidence for one-electron oxidation of phenols by a dimeric manganese (IV/IV) triazacyclononane complex in the presence and absence of hydrogen peroxide," J. Chem. Soc., Perkin Trans. 2, Jan. 1997, pp. 2151-2165.
Hammel et al., "Communication," Arch. Biochem. Biophys. Apr. 1989, vol. 270, pp. 404-409.
Heiba et al., "Oxidation by Metal Salts. III. The Reaction of Manganic Acetate with Aromatic Hydrocarbons and the Reactivity of the Carboxymethyl Radical," Heiba et all, Jan. 1969, vol. 91, pp. 138-145.
Ho et al., "A Simple and Effective Catalytic System for Epoxidation of Aliphatic Terminal Alkenes with Manganese(II) as the Catalyst," Chemistry —A European Journal, 2008, vol. 14, pp. 7988-7996.
Hofrichter, "Review: lignin conversion by manganese peroxidase (MdP)," M. Enzy. Microb. Tech., 2002, vol. 30, pp. 454-466.
Jacobsen et al., "Oxidation of manganese(II) by ozone and reduction of manganese(III) by hydrogen peroxide in acidic solution," Int. J. Chem. Kinetics, 1998, vol. 30, pp. 207-214.
Khindaria et al., "Lignin Peroxidases Can Also Oxidize Manganese," Biochemistry, Mar. 1995, vol. 34, pp. 7773-7779.
Kurek et al., "Oxidation of Spruce Wood Sawdust by $MnO_2$ Plus Oxalate: A Biochemical Investigation", J. Agric. Food Chem., 2000, vol. 48, pp. 3058-3062.
Kuwahara et al., "Separation and characterization of two extracellular $H_2$ $O_2$ -dependent oxidases from ligninolytic cultures of Phanerochaete chrysosporium," FEBS Lett., 1984, vol. 169, No. 2, pp. 247-250.
Larsen et al., "Hydrocarbon Oxidation by Bis-μ-oxo Manganese Dimers: Electron Transfer, Hydride Transfer, and Hydrogen Atom Transfer Mechanisms," J. Am. Chem. Soc., Aug. 2002, vol. 124, pp. 10112-10123.
Linker, "Manganese (III) acetate —A Versatile Reagent for Radical Generation and C-C Bond Formation," J Prakt. Chem., Feb. 1997, vol. 339, pp. 488-492.
Linker et al., "Transition-Metal-Mediated Radical Reactions as an Easy Route to 2-C-Analogues of Carbohydrates," Angew. Chem. Int. Ed. , Apr. 1996, vol. 35, pp. 1730-1732.
Lucas et al., "Ionic Liquid Pretreatment of Poplar Wood at Room Temperature: Swelling and Incorporation of Nanoparticles," ACS Appl. Mater. Interfaces, Jul. 15, 2010, vol. 2, pp. 2198-2205.
Morita et al., "Synthesis and Properties of Tris(3-hydroxy-2-methyl-4-pyronato) Complexes of Chromium(III), Manganese(III) and Iron(III)," Chemistry Letters, 1975, pp. 339-342.
Mostabhim et al., "Novel Oxidation of Phenols to Quinones by Hydrogen Peroxide in the Presence of Cobalt (II) and Manganese (II) Acetate," Acta Chim Slov., 2003, vol. 50, pp. 569-572.
Nickolov et al., "Raman study of complexation in aqueous solutions of magnesium acetate," J. Mol. Struct., 1996, vol. 377, pp. 13-17.
Onnerud et al., "Polymerization of Monolignols by Redox Shuttle-Mediated Enzymatic Oxidation: A New Model in Lignin Biosynthesis I, " The Plant Cell, Aug. 2002, vol. 14, pp. 1953-1962.
Partenheimer, "The Aerobic Oxidative Cleavage of Lignin to Produce Hydroxy-aromatic Benzaldehydes and Carboxylic Acids via Metal/Bromide Catalysts in Acetic Acid/Water Mixtures," Adv. Synth. Catal., 2009, vol. 351, pp. 456-466.
Paszcaynski et al., "Delignification of Wood Chips and Pulps by Using Natural and Synthetic Porphyrins: Models of Fungal Decay," Appl. Environ. Microbiol., Jan. 1988, vol. 54, pp. 62-68.
Sawyer et al., Metal [MLx; M = Fe, Cu, Co, Mn]/Hydroperoxide-Induced Activation of Dioxygen for the Oxygenation of Hydrocarbons: Oxygenated Fenton Chemistry, Accounts of Chemical Research, 1996, vol. 29, pp. 409-416.
Schenzel et al., "New Method for Determining the Degree of Cellulose I Crystallinity by Means of FT Raman Spectroscopy" Cellulose, Apr. 2005, vol. 12, pp. 223-231.
Serrano-Ruiz et al., "Catalytic routes for the conversion of biomass into liquid hydrocarbon transportation fuels," 2011, vol. 4, pp. 83-89, published on Nov. 30, 2010.
Sims et al., "An overview of second generation biofuel technologies," Bioresour. Technol., 2010, vol. 101, pp. 1570, available online Dec. 2009.
Stark et al., "Oxidative Depolymerization of Lignin in Ionic Liquids," ChemSusChem, 2010, vol. 3, pp. 710-723.
Tzedakis et al., "Kinetic Study of Binuclear Manganese-Tris(2-methyl pyridyl)amine Complex Used as a Catalyst for Wood Pulp Bleaching,", Ind. Eng. Chem. Res., 2001, vol. 40, pp. 3435-3444.
Tzedakis, "Electrochemical study of binuclear manganese complexes as catalysts in Kraft pulp bleaching," Electrochim. Acta, 2000, vol. 46, pp. 99-109.
Wang et al., "Raman Spectroscopic Studies on Single Supersaturated Droplets of Sodium and Magnesium Acetate," J. Phys Chem. A, Jan. 2005, vol. 109, pp. 609-614.
Wariishi et al., "Manganese peroxidase from the lignin-degrading basidiomycete Phanerochaete chrysosporium. Transient state kinetics and reaction mechanism," J. Biol. Chem., Feb. 1989, vol. 264, pp. 3335-3340.
Wekesa et al., "Further Understanding of the Chemistry of Manganese-Induced Peroxide Decomposition," Can. J. Chem. Eng., Oct. 2003, vol. 81, pp. 968-972.
Wells et al., "The kinetics of the reaction of aquomanganese(III) ions with hydrogen peroxide in perchlorate media," J. Chem Soc. A, 1968, pp. 665-667.
Wiley et al., "Band Assignments in the Raman spectra of celluloses," Carbohydrate Res., 1987, vol. 160, pp. 113-129.
Yamaguchi et al., "Redox chemistry for the mononuclear tris(picolinato)-tris(acetylacetonata)-, and tris(8-quinolata) manganese(III) complexes: reaction mimics for the water oxidation cofactor in photosystem II," Inorg. Chem., 1985, vol. 24, pp. 971-976.

* cited by examiner

PROCESS FOR DECOMPOSING LIGNIN IN BIOMASS

STATEMENT REGARDING FEDERAL RIGHTS

This invention was made with government support under Contract No. DE-AC52-06NA25396 awarded by the U.S. Department of Energy. The government has certain rights in the invention.

FIELD OF THE INVENTION

The present invention relates generally to a process for treating lignocellulosic biomass by decomposing the lignin in the lignocellulosic biomass.

BACKGROUND OF THE INVENTION

Lignocellulosic biomass is plant biomass that includes cellulose, hemicellulose, and lignin. Cellulose and hemicellulose are carbohydrate polymers that are tightly bound to the lignin. Lignocellulosic biomass can be grouped into four main categories: (1) agricultural residues; (2) energy crops; (3) wood residues, including sawmill and paper mill discards; and (4) municipal paper waste. Lignocellulosic biomass represents a potentially sustainable source of fuel and commodity chemicals, offers economic advantages over corn starch for the production of biofuels, and could contribute to carbon sequestration without impacting food crop prices. Lignocellulosic biomass could satisfy the energy needs for transportation and electricity generation, while contributing to carbon sequestration and limiting the accumulation of greenhouse gases in the atmosphere.

Potential feedstocks of lignocellulosic biomass are abundant and include crops (e.g. corn and sugarcane), agricultural wastes, forest products (e.g. wood), grasses, and algae. Among the feedstocks, wood has been widely used for the production of paper, as a construction material, and as a solid fuel. Wood is composed mainly of cellulose, hemicellulose, and lignin. Lignin includes an amorphous network of crosslinked phenylpropanoid units.

The conversion of lignocellulosic biomass into liquid fuels and/or other commodity chemicals typically includes the following steps: (1) pretreatment; (2) hydrolysis of cellulose and hemicellulose into fermentable sugars; and (3) fermentation of the sugars into the liquid fuels (e.g. ethanol) and other commodity chemicals. The pretreatment is energy-intensive but necessary due to the complex structure of the plant cell wall and the chemical resistance of lignin, which limits the access of enzymes to cellulose. An ideal pretreatment should break the lignocellulosic complex, increase the active surface area, and decrease the cellulosic crystallinity while limiting the generation of inhibitory by-products and minimizing hazardous wastes and wastewater.

A major bottleneck in the large-scale conversion of biomass to biofuels is the pretreatment delignification process that provides enzymes access to cellulose, the main source of fermentable sugars. Most current pretreatments, such as ammonia fiber explosion, alkaline hydrolysis, and acid hydrolysis, require high temperatures that increase the operation costs and generate toxic byproducts. The pretreatment is also the most expensive step in the conversion of lignocellulosic biomass to ethanol. Less expensive pretreatments that are environmentally friendly are desirable.

Various treatments have been investigated for removing the lignin, which would improve the yield of fermentable sugars for the production of biofuels. Most of these treatments are energy-intensive and/or generate toxic byproducts that affect their economic viability. A "green" pretreatment strategy was reported to replicate and optimize the enzymatic activity of natural white rot fungi such as *Phanerochaete chrysosporium*, which degrade biomass completely, including the lignin. The reactivity of the manganese-dependent peroxidase enzyme produced from *P. chrysosporium* was studied with lignin model compounds. The enzyme requires $Mn^{II}$ and $H_2O_2$ to degrade lignin. The reaction is proposed to involve the oxidation of $Mn^{II}$ to $Mn^{III}$, a known one-electron oxidant. Stoichiometric $Mn(OAc)_3$ was shown to oxidize guaiacyl and syringyl lignin models at a pH ranging from 2.5 to 4.1 at room temperature. The use of $Mn(OAc)_3$ as a catalyst for the delignification of wood with $H_2O_2$ has not been reported.

Studies involving the use of transition metal catalysts and $H_2O_2$ for the oxidative delignification of wood have been reported. A study related to the ability of several metalloporphyrins based on Fe, Co, Zn and Mn to oxidize lignin models has been reported. This work has been limited by the complex nature of these metalloporphyrins and their costly synthesis, as well as difficulties associated with catalyst recovery. Several other Mn and Fe complexes of synthetic macrocyclic ligands, including $[(TACN)Mn(\mu\text{-}O)_3Mn(TACN)](PF_6)_2$ (TACN=1,4,7-trimethyl-1,4,7-triazacyclo-nonane) and polypyridyl ligands, were shown to catalyze the delignification of wood using hydrogen peroxide. Methyl-trioxorhenium was reported to catalyze the oxidation of lignin model compounds and lignin. Although promising activity was observed at 60° C. using $[(TACN)Mn(\mu\text{-}O)_3Mn(TACN)](PF_6)_2$, the expensive synthetic ligands have limited the application of this type of catalyst.

A combination of $Co(OAc)_2$ and $Mn(OAc)_2$ was reported to catalyze the aerobic auto-oxidation of lignin in acetic acid solution at 140-220° C. In ionic liquid solution, $Mn(NO_3)_2$ and $CoCl_2$ were found to catalyze the oxidation of various lignin and lignin models in air, but this also requires elevated temperatures (80-100° C.) and/or high pressures (83 atm).

A simpler process for delignification of lignocellulosic biomass may improve the economic viability of oxidative delignification.

SUMMARY OF THE INVENTION

To achieve the foregoing and other objects, and in accordance with the purposes of the present invention, as embodied and broadly described herein, the present invention provides a process for treating lignocellulosic biomass. The process involves dissolving manganese (III) acetate into water to form a first aqueous solution, combining an aqueous solution of hydrogen peroxide with the first aqueous solution to form a second aqueous, said second aqueous solution comprising a pH of less than about 6, providing lignocellulosic biomass that includes lignin, and combining the second aqueous solution with the lignocellulosic biomass under conditions suitable for the decomposition of the lignin, thereby treating the lignocellulosic biomass.

DETAILED DESCRIPTION

The invention relates to a process for the treatment of lignocellulosic biomass by delignification of the biomass. The process is inexpensive, simple, and effective under ambient conditions. The process may be applied to any biomass that contains lignin. When the process is applied to wood, for example, the result is delignification of the wood. The process may be used for the delignification of grasses such as but not limited to switchgrass, The process may be used for the delignification of non-food agricultural waste material, such as but not limited to wood (e.g. wood chips), plant residues, corn stover, grain husks, etc. In short, the process can be used for the delignification of substrates that contain lignin. It should be understood that the invention is not limited use with any particular type of types of lignin (organosolv lignin, kraft lignin, etc.). In an embodiment, manganese (III) acetate ($Mn(OAc)_3$) catalyzes the delignification of wood at room temperature in aqueous solution using hydrogen peroxide. In another embodiment, manganese (II) acetate in an acetate buffered solution also catalyzes the delignification of lignocellulosic biomass using hydrogen peroxide. In other embodiments, manganese (II) triflate (i.e. trifluoromethanesulfonate) or manganese trifluoroacetate are expected to also catalyze the delignification of lignocellulosic biomass using hydrogen peroxide. The process can be performed at ambient temperature and also at elevated temperatures that do not exceed the decomposition temperature of hydrogen peroxide, which is about 150° C. Temperatures of 145° C., 140° C., 135° C., 130° C., 125° C., 120° C., 110° C., 105° C., 100° C., 95° C., 90° C., 85° C., 80° C., 75° C., 70° C., 65° C., 60° C., 55° C., 50° C., 45° C., 40° C., 35° C., 30° C., 25° C., ambient temperature, and temperatures in between any of these values, are all suitable for the process. Reaction times for the decomposition of the lignin of a week or less (e.g. 6 days, 5 days, 4 days, 3 days, 2 days, 1 day, less than 1 day, and all times in between) are suitable reaction times, as well as times greater than one week. Also within the scope of the invention are concentrations of hydrogen peroxide in the hydrogen peroxide solution of about 30% or less. Concentrations of the manganese containing solution up to about 2 Molar are also within the scope of this invention.

An initial assessment was made using different manganese-containing materials for carrying out the delignification of wood. Multiple poplar wood sections of comparable sizes (50 μm thickness) were immersed in $H_2O_2$ solutions (2.2 M) containing the complexes (50 mM). Several manganese-containing materials were tested, including $Mn(OAc)_3$, $Mn(acac)_3$ (acac=acetylacetonate), $MnO_2$, $Mn(pic)_3$ (Hpic=picolinic acid), $Mn(pic)(dipic)(H_2O)$ (Hdipic=dipicolinic acid), $NMe_4[Mn(opba)(H_2O)_2]$ (opba=o-phenylenebis(oxamate)) and $Mn(malt)_3$ (malt=maltol). The reaction mixtures were monitored by optical microscopy. Only the solution containing $Mn(OAc)_3$ caused visible degradation of the lignocellulosic matrix of poplar at room temperature within a few days. For the other complexes, the poplar section kept its integrity even after seven days, and the samples remained unchanged microscopically. Control experiments under identical conditions with hydrogen peroxide only (2.2 M) and hydrogen peroxide (2.2 M) with an acetate buffer (150 mM) showed no visible changes to the wood structure. No visible changes were observed using a variety of other transition-metal-containing salts including $FeCl_2$, CuCl, $Cu(OAc)_2$, $MnSO_4$, $NaVO_3$, or $Co(OAc)_2$, under otherwise identical conditions.

The visible changes occurring to the wood structure upon exposure to the solution containing $Mn(OAc)_3$ and hydrogen peroxide were then investigated in more detail. When immersed without any vigorous agitation, the poplar section broke down in smaller fragments in the presence of $Mn(OAc)_3$ after two days at room temperature. The poplar fragments grew visibly smaller, and after five days, the poplar section turned into a fine solid residue at the bottom of the vial. With only mild manual agitation, the poplar section became fragmented in less than one day. The pH of the $Mn(OAc)_3$ solution was originally less than about 6. A pH from about 3.0 to about 5.5 may be used. In an embodiment, the pH was 4.6 before the introduction of the sample and remained so after seven days. When monitored by optical microscopy, the lignin-rich middle lamella between cells and the cell corners became darker and wider. After a one-day treatment and mild manual agitation, the poplar section was cleaved along the ray parenchyma cells, the middle lamella, and vessels. Rows of poplar cells, as well as individual cells, became free from large fragments and laid on their side on the Petri dish. In some areas, loose material from the wood decomposition covered entirely the underlying wood structure. Some bubbling was also observed, particularly around cells damaged by mechanical action (cutting and manipulation during sample preparation), and along the ray parenchyma cells. The wood fragments became smaller and after 3 days, only a few large fragments with more than several hundred cells remained. Isolated cells and short rows of cells were then commonly seen. Although the middle lamella between cells became looser and wider, the cellulose-rich cell walls remained relatively intact, even after five days. However after seven days, even individual cells were visibly degraded. At this time, the sample was left to dry in air and microscopic images revealed a seemingly amorphous film covering the bottom of the Petri dish.

To characterize the Chemical degradation, Raman images were collected from the poplar section before and after a one-day catalytic treatment. Two representative cells were selected from two different areas on the sample. For a sample that was left to dry overnight, the middle lamellae and cell corners appeared to widen. This result following drying was consistently reproduced in multiple experiments. Raman images of cellulose and lignin were obtained by integrating over the wave number ranges of 1070-1170 $cm^{-1}$ and 1590-1640 $cm^{-1}$, respectively. These spectral ranges included the 1096, 1121, 1152 $cm^{-1}$ bands from cellulose, and the 1602 and 1620 $cm^{-1}$ bands from lignin. Due to a weak signal-to-ratio for lignin, a linear background was subtracted from the integrated data. An overall decrease in the cellulose and lignin Raman signal was observed after the one-day treatment. This decrease was not attributable to a smaller sample thickness because the laser penetration depth was smaller than 6 micrometers (μm) and all cells lying on their side had a thickness of about 50 μm after a three-day treatment. The Raman signal decrease indicates a loss of material, particularly in the case of lignin, where the signal was barely above the noise level after treatment. For the cellulose, the signal decrease could indicate a loss of material or a decrease in the crystallinity.

The catalytic degradation was pronounced along the lignin-rich middle lamellae. Prior to the treatment, the cellulose was mostly concentrated in the secondary cell wall, while the lignin was concentrated along the middle lamellae and in the cell corners. After treatment, the cellulose signal was strongest in the secondary cell wall layers closest to the lumens, while it remained strong close to the middle lamellae. No lignin was detected in the widened middle lamellae, while only traces remained in the secondary cell wall layers closest to the middle lamellae. These results confirmed a delignification and the loosening of the lignocellulosic matrix, which led to the fragmentation of the sample.

Raman spectra collected from areas that included multiple poplar cells further confirmed the delignification process. In the dry wood spectrum, the cellulose and lignin bands were clearly visible in the spectral ranges 1070-1170 $cm^{-1}$ and 1590-1640 $cm^{-1}$, respectively. The bands located between 1270 and 1380 $cm^{-1}$ have previously been assigned to various stretching vibrations in cellulose and lignin. The Raman spectrum collected from the solid residue that remained upon evaporation of the catalyst solution exhibited a strong band at around 940 $cm^{-1}$, which was assigned to acetate anion. After treatment of the wood with $Mn(OAc)_3/H_2O_2$, Raman spectra were collected from the remaining solid residues. Raman spectra of the amorphous film indicated the presence of manganese acetate and cellulose. The Raman spectrum from dried poplar fragments similar to those shown in FIGS. 2e and 2h still exhibited strong cellulose bands at 1096 and 1121 $cm^{-1}$ with limited broadening, while the lignin bands at 1602 and 1620 $cm^{-1}$ were absent. The bands located between 1270 and 1380 $cm^{-1}$ became also absent. The Raman spectra show that the delignified wood product is very pure in cellulose with little detectable lignin.

To assess the pretreatment effect on biomass conversion, poplar sawdust pretreated with $Mn(OAc)_3$ (50 mM) and hydrogen peroxide (2.2 M) for 2, 4 and 7 days was subjected to enzymatic hydrolysis for 24 hours at 55° C. Poplar sawdust exposed for the same durations to water only were also prepared as controls. The glucose concentration in the broth resulting from enzymatic hydrolysis was then determined by a LC/MS analysis, Before the enzymatic treatment of the wood, the excess solution containing hydrogen peroxide and Mn was removed and the solid residue was immersed in 10 mL of deionized water for 24 hours. All samples, including controls, were then rinsed five times with deionized water. The rinsing was necessary because similar control experiments conducted on sawdust exposed to $H_2O_2$ (2.2 M) only resulted in lower glucose yields compared to the controls exposed only to water. These results suggested that the excess hydrogen peroxide and/or Mn inhibited the enzymatic activity involved in cellulose hydrolysis.

LS/MS data showed a small increase in glucose yield for the controls only exposed to water with increasing exposure time. This can be partially explained by the overall expansion of wood cells in water, which is known to widen pits in the cell wall and improve the access of enzymes. For the rinsed pretreated samples, the glucose yield was consistently higher than the controls, showing an improvement ranging from 20% to 40%. The improved glucose yield observed after a two-day treatment means that longer pretreatments of several days are unnecessary for this treatment to have a positive effect on biomass conversion. For the treated samples, the aqueous solutions removed from the samples during rinsing contained an unknown amount of white insoluble solid residue that was excluded from enzymatic hydrolysis, In contrast, the solutions removed from the controls were clear. Optical microscopy and Raman spectroscopy showed that this solid residue was mostly constituted of individual delignified wood cells and amorphous cellulose. This material loss may have reduced the amount of delignified wood and cellulose available for hydrolysis. The improved yields mentioned above therefore underestimate the pretreatment effect on biomass conversion.

Upon dissolving $Mn(OAc)_3$ in water, a dark brown precipitate formed immediately, presumably due to the well-known disproportionation of $Mn(OAc)_3$ in the absence of excess acetic acid. Slow addition of hydrogen peroxide to the mixture resulted in initial bubbling accompanied by dissolution of the solid, forming a clear, colorless solution of pH 4.6. The absence of color suggests that $Mn^{II}$ is the dominant species in solution. Both $Mn^{III}$ and $Mn^{IV}$ have been reported to be reduced to $Mn^{II}$ by $H_2O_2$ under acidic conditions. Consistent with this idea, a solution of $Mn^{II}(OAc)_2$ (50 mM), acetic acid (HOAc) (100 mM), and $H_2O_2$ (2.2 M) showed similar catalytic activity to the original solution prepared from $Mn^{III}(OAc)_3$ (50 mM) and $H_2O_2$ (2.2 M). Furthermore, identical UV-vis spectra were obtained from an aqueous solution prepared from $Mn^{III}(OAc)_3$ and $H_2O_2$ (2 equiv) and an aqueous solution prepared from $Mn^{II}(OAc)_2$, (1 equiv), and $H_2O_2$ (1.5 equiv).

The pH of the solution was found to affect the catalytic activity. For example, an unbuffered solution of $Mn^{II}(OAc)_2$ and $H_2O_2$ at a pH of about 6.0 underwent rapid, vigorous bubbling due to catalytic disproportionation of the hydrogen peroxide. A similar reaction was observed upon raising the pH of the solution prepared from $Mn^{III}(OAc)_3$ and $H_2O_2$ above pH of approximately 6 by addition of sodium carbonate or sodium phosphonate buffer. This catalase-type reactivity of manganese is well-known and resulted in complete consumption of the $H_2O_2$ within several hours at room temperature, preventing the delignification activity. In contrast, the $H_2O_2$ was consumed much more slowly in a solution of $Mn^{III}(OAc)_3$ (50 mM) at pH 4.6, diminishing from an initial concentration of 2.2 M to approximately 1.1 M only after 7 days.

Detailed studies of the pH dependence of the catalytic reaction were complicated by the finding that the catalytic reaction was affected by the presence of other types of ions in solution. For instance, carrying out the reaction with added NaCl (0.2, 1, and 2M) resulted in slower fragmentation of the wood. Likewise, increasing the concentration of acetate buffer (to 0.2, 0.5, 1, and 2 M) also resulted in a qualitative decrease in the observed fragmentation rate. No delignification was observed using $Mn(OAc)_3$ and $H_2O_2$ in $NaH_2PO_4$ buffers (0.5 M, pH~1.6 M or 2.5 M). As discussed above, rapid disproportionation was observed upon addition of $H_2O_2$ to a solution of $Mn(OAc)_3$ in $Na_2HPO_4$ buffer (0.5 M, pH~6.5) or $Na_2CO_3$ buffer (0.5 M, pH of about 9.9).

There are a variety of possible mechanisms for the manganese-catalyzed reaction. Previous studies of the oxidation of phenolic arylglycerol β-aryl ether lignin dimers by Mn-peroxidases proposed both single electron transfer and hydrogen atom abstraction pathways. Detailed studies suggest that hydride transfer, electron transfer, and hydrogen atom transfer pathways are all possible in the reactions of high-valent Mn-oxo dimers. Hydrogen atom abstraction was also proposed for oxidations of alkyl aromatics by Mn(IV) and Mn(V) oxo porphyrins. A number of other mechanisms have been invoked for Mn-based oxidations, including oxo-transfer from a high-valent Mn complex, which is commonly proposed in olefin epoxidation and other oxidation reactions. Notably, $Mn^{II}$ salts were recently found to catalyze the epoxidation of olefins in acetonitrile/water solution using peroxyacetic acid as the oxidant. Alternatively, a radical mechanism could be involved for the wood oxidation. Sawyer and others have found that several Mn complexes, including Mn(salen), catalyze oxygenated Fenton-type chemistry, activating $O_2$ in the presence of $^t$BuOOH to oxidize hydrocarbons via radical intermediates. Consistent with this idea, recent work involving the treatment of spruce wood with several iron salts under acidic conditions has shown that Fenton-type chemistry can degrade the lignocellulose matrix, producing fragments high in cellulose. However, a combination of $MnCl_2$ and 2,3-dihydroxybenzoic acid was found to be ineffective at inducing delignification under the reaction conditions. Due to the variety of pathways known for Mn-based oxidations and the complex nature of the wood substrate, the mechanisms of oxidation are under investigation.

More details related to the experimental procedures are described below. Unless specified otherwise, all manipulations were carried out under air at ambient temperature. All chemicals were obtained from FISHER SCIENTIFIC and used as received. UV-Vis spectra were obtained on an AGILENT UV-Vis spectrometer 8743. Complexes $Mn(pic)_3$ (Hpic=picolinic acid), $Mn(pic)(dipic)(H_2O)$ (Hdipic=dipicolinic acid), $NMe_4[Mn(opba)(H_2O)_2]$ (opba=o-phenylenebis(oxamate)) and $Mn(malt)_3$ (malt=maltol) were prepared according to published procedures. Transverse sections of poplar wood (*Populus tremuloides*) of 50 μm thickness were prepared using a sliding microtome. The sections were dried in an oven for 4 hours between glass slides at 60° C. to prevent curling. pH measurements were recorded using an IQ150 pH meter (IQ Scientific Instruments, Carlsbad, Calif.).

Oxidation of Wood Using Transition Metal Salts.

In a small glass vial, an appropriate amount of a metal salt ($FeCl_2$, CuCl, $Cu(OAc)_2$, $Mn(OAc)_3$, $MnSO_4$, $NaVO_3$, $Fe(OAc)_2$, or $Co(OAc)_2$) corresponding to 0.10 mmol of the salt was dissolved in deionized water (1.5 mL). Hydrogen peroxide (0.5 mL of a 30% aqueous solution, 4.4 mmol) was added dropwise, resulting in vigorous bubbling in some cases. A 5×8 $mm^2$ poplar section was then immersed in the vial, and the reaction was monitored by a time-lapse series of photographs collected over a period of seven days.

Determination of Hydrogen Peroxide Concentration in Transition Metal Salt Solutions.

Hydrogen peroxide concentrations were determined by a previously published procedure involving spectrophotometric titration with an aqueous solution of ammonium heptamolybdate (see: Chai, X.-S.; Hou, Q. X.; Luo, Q.; Zhu, J. Y. *Anal. Chim. Acta* 2004, 507, 281-284, incorporated by reference). A stock solution was prepared by dissolving $(NH_4)_6Mo_7O_{24}.4H_2O$ (0.10 g, 0.081 mmol) in 250 mL of a 0.5 M solution of $H_2SO_4$. In a small glass vial, the appropriate metal acetate salt ($Cu(OAc)_2$, $Mn(OAc)_3$, $Mn(OAc)_2$, $Fe(OAc)_2$, or $Co(OAc)_2$, 0.10 mmol) was dissolved in deionized water (1.5 mL). Hydrogen peroxide (0.5 mL of a 30% aqueous solutions, 4.4 mmol) was added dropwise. After 10-15 minutes, the initial concentration of $H_2O_2$ was measured by spectrophotometric titration after mixing 4 microliters (μL) of the sample with 1 mL of a solution of $(NH_4)_6Mo_7O_{24}.4H_2O$ in a quartz cuvette. The $H_2O_2$ concentration of the as-produced sample and the sample diluted ten times was provided by their absorbance at 350 nm. Calibration was performed with $H_2O_2$ solutions of concentrations 0%, 0.3%, 0.6%, 0.9% and 1.2%. The concentrations of $H_2O_2$ in each vial were determined again by titration once every 24 hours for 7 days.

Oxidation of Wood with $Mn(OAc)_3$.

In a small glass vial, $Mn(OAc)_3$ (27 mg, 0.10 mmol) was suspended in deionized water (1.5 mL). A dark brown precipitate formed immediately. Upon dropwise addition of $H_2O_2$ (0.5 mL of a 30% aqueous solution, 4.4 mmol), slight bubbling was observed and the brown solid dissolved, forming a clear, colorless solution of pH 4.6. A 5×8 $mm^2$ poplar section was immersed in a vial containing 2 mL of this catalyst solution and a time-lapse series of photographs was collected over a period of seven days. For high-resolution images, another 4×8 $mm^2$ section was kept immersed in 2 mL of catalyst solution contained in a polystyrene Petri dish for seven days. The Petri dish was regularly filled with the catalyst solution to compensate for evaporation and keep the solution volume constant. Just before imaging, the Petri dish was partially drained to reduce foaming and keep the sample close to the low working-distance objective. Optical images were collected in transmission with a ZEISS AXIOVERT 200M (Göttingen, Germany) inverted microscope using a 63× oil objective (NA 1.25). After the imaging session, the Petri dish was refilled with the catalyst solution.

Effect of $Mn(OAc)_3/H_2O_2$ Pretreatment on Glucose Yield from Cellulose Treatment.

In a glass vial, $Mn(OAc)_3$ (402 mg, 1.5 mmol) was suspended in deionized water (11.25 mL). Dropwise addition of $H_2O_2$ (3.75 mL of a 30% aqueous solution, 33.0 mmol) resulted in initial bubbling, forming a clear, colorless solution. To assess the efficiency of the pretreatment on the glucose yield after enzymatic hydrolysis, 500 mg of poplar sawdust (20-30 mesh) was placed in each of six glass test tubes. Three of the six samples were immersed for 2, 4, or 7 days in 5 mL of the $Mn(OAc)_3/H_2O_2$ solution prepared as described above, while the other three were immersed in 5 mL of deionized water (control) for the same durations. After the treatment, the supernatant solution was removed from the pretreated sample by pipette and the solid residue was immersed in 10 mL of water for 24 h to remove the remaining $H_2O_2$ and catalyst. Each sample was then rinsed five times with 5 mL of deionized water before enzymatic hydrolysis. At each rinsing, the excess water was extracted with a pipette.

Enzymatic Cellulose Hydrolysis.

Cellulases (Celluclast 1.5 L from *Trichoderma reesei*) and cellobiases (NOVEZYME 188 from *Aspergillus niger*) were obtained from NOVOZYMES (Franklinton, N.C.). The weight ratios of Celluclast 1.5 L and NOVOZYME 188 to wood were 1% and 0.05%, respectively. The enzyme mixture of cellulases and cellobiases was prepared in 0.05 M sodium acetate buffer at pH 4.8. Five mL of enzyme solution was added to the nine sawdust samples (500 mg each). The enzymatic hydrolysis took place in a water bath maintained at 55° C. for 24 h. After hydrolysis, the broth was filtered using 0.2 μm Spartan-3 filters with Teflon membranes (SCHLEICHER & SCHUELL BIOSCIENCE, Keene, N.H.) before liquid chromatography/mass spectrometry (LC/MS) analysis.

Raman Microscopy.

Raman spectra and images were collected with the 776 nm laser line of a tunable Ti:Sapphire laser (Mira 900-P, Coherent, Palo Alto, Calif.) coupled with a 532 nm solid state laser (MILLENIA VIIIs, SPECTRA-PHYSICS, Mountain View, Calif.). The laser beam was focused to a line using a plano-convex BK 7 150 mm focal length cylindrical lens (CKX150AR.16, Newport Corp., Irvine, Calif.) and redirected to an inverted microscope (CARL ZEISS AXIOVERT 200, Göttingen, Germany) by a Raman edge dichroic (z785rdc, CHROMA TECHNOLOGY, Rockingham, Vt.). At the sample, the laser line is about 1 μm wide and 100 μm long, with a total power of 80 mW at the sample. The sample was illuminated and the Raman signal was collected in a backscattering geometry through the same C-apochromat 63× water immersion objective (NA 1.2, CARL ZEISS). The Raman signal was focused onto the entrance of a HOLOSPEC f/2.2 spectrograph (KAISER OPTICAL SYSTEMS Ann Arbor, Mich.) and filtered with a Holographic Super-Notch-Plus Filter (HSPF-785.0AR-2.0, KAISER OPTICAL SYSTEMS, Ann Arbor, Mich.). The signal was then dispersed with a holographic grating (HSG-785-LF, KAISER) and imaged with a liquid nitrogen-cooled CCD camera (LN/CCD-1024E, PRINCETON INSTRUMENTS, Trenton, N.J.). The spectrometer was calibrated spectrally with 4-acetamidophenol, and spatially using a USAF-1951 resolution test target. The CCD images were corrected for CCD bias voltage, spherical aberrations, and the non-uniform power along the focused laser line. Raman images were acquired line by line by moving the sample by 0.5 μm steps with an exposure time of 2 min for each line. Raman spectra were obtained by integrating CCD images spatially over the area of interest. The exposure time for spectra is 30 s. Bright-field images were collected from an InfinityX-32 camera (LUMENERA CORP., Ottawa, Canada) through the same objective.

Liquid Chromatography/Mass Spectrometry Analysis (LC/MS).

For quantitation of glucose, 400 μL aliquots of each sample were diluted with a 10 mM ($^{13}C_6$ 1,2,3,4,5,6,6-$d_7$, M+13) isotope enriched glucose standard solution in water such that the final concentration was 0.750 mM, 3 mM, and 6 mM in enriched glucose. A Thermo Scientific LTQ XL 2D linear quadrupole ion trap mass spectrometer interfaced with an electrospray ionization source and equipped with a Surveyor LC system was used. Separations were performed using a GLYCOSEP R HPLC column (4.6 mm×150 mm) (PROZYME, California, USA). The injection volume was 10 μL. A 5 min linear gradient (acetonitrile 5-10%, 0.1% formic acid in water 88-83%, methanol 7%) was used at a flow rate of 500 μL/min. Retention times for both glucose and isotope enriched glucose were 2.9-3.4 min. After 5 min, the gradient changed to 83% acetonitrile to wash the column for 2 min, followed by a 3 min hold at original concentrations to re-equilibrate the column. Blank water runs were performed between each sample to ensure complete washing of the column. The mass spectrometer was operated in positive, single ion mode. The total ion count for the M+1 peaks of glucose (m/z 181) and the isotope enriched glucose (m/z 194) were compared for each dilution concentration of each sample. The ratio of the two peaks, the known concentration of the isotope enriched glucose, and volume corrections were used to calculate the concentration of native glucose. The peak ratios were also compared using negative ion mode and found to be consistent across samples.

Oxidation of Wood with Added NaCl.

$Mn(OAc)_3$ (27 mg, 0.10 mmol) was added to each of 3 vials. NaCl (0.024 g, 0.41 mmol) was added to the first vial. To the second vial, NaCl (0.116 g, 2.0 mmol) was added. NaCl (0.232 g, 4.0 mmol) was also added to the third vial. Deionized water (1.5 mL) and $H_2O_2$ (0.5 mL of a 30% aqueous solution, 4.4 mmol) were then added to each of the three vials. A 5×8 $mm^2$ poplar section was then immersed in each vial and a time-lapse series of photographs was collected over a period of seven days. Fragmentation of the wood piece was observed in each vial, but the fragmentation occurred more slowly with increasing concentration of NaCl, with the third vial (2 M NaCl) breaking into a few fragments only after several days at room temperature.

Oxidation of Wood with Added Acetate Buffer.

$Mn(OAc)_3$ (27 mg, 0.10 mmol) was added to each of 5 vials, suspended in deionized water (1 mL), and $H_2O_2$ (0.5 mL of a 30% aqueous solution, 4.4 mmol) was added. Acetic acid was then added to vial 2 (23 μL, 0.37 mmol), vial 3 (57 μL, 0.91 mmol), vial 4 (114 μL, 1.81 mmol), and vial 5 (228 μL, 3.62 mmol). The pH was recorded in each vial, and then adjusted to ca. 4.6 by addition of a 5 M NaOH solution (30-320 μL, 0.15-1.6 mmol). A final volume of 2 mL was then obtained by addition of deionized water. A 5×8 $mm^2$ poplar section was then immersed in each vial and a time-lapse series of photographs was collected over a period of seven days. The degree of fragmentation decreased with increasing concentration of acetate buffer, with the sample immersed in 2 M acetate buffer remaining intact even after seven days.

Oxidation of Wood in $Na_2CO_3$ Buffer.

In a small vial, $Mn(OAc)_3$ (27 mg, 0.10 mmol) and $Na_2CO_3$ (106 mg, 1.0 mmol) were dissolved in deionized water (1.5 mL), forming a suspension of pH 9.9. Dropwise addition of $H_2O_2$ (0.5 mL of a 30% aqueous solution, 4.4 mmol) resulted in violent bubbling, which subsided after 10-15 minutes. At this time, the pH of the solution was recorded to be 9.6. A 5×8 $mm^2$ poplar section was then immersed in the vial and the reaction monitored over a period of seven days. No fragmentation of the wood was observed.

Oxidation of Wood in $NaH_2PO_4$ Buffer, pH=1.6.

In a small vial, $Mn(OAc)_3$ (27 mg, 0.10 mmol) and $H_3PO_4$ (0.84 mL, of a 1.2 M aqueous solution, 1.0 mmol) were combined with aqueous NaOH (35 μL of a 5 M aqueous solution, 0.18 mmol). The final volume was adjusted to 1.5 mL by addition of deionized water, and then $H_2O_2$ (0.5 mL of a 30% aqueous solution, 4.4 mmol) was added. At this time, the pH of the solution was found to be 1.6. A 5×8 $mm^2$ poplar section was then immersed in the vial and the reaction monitored over a period of seven days. No fragmentation of the wood was observed.

Oxidation of Wood in $NaH_2PO_4$ Buffer, pH=2.5.

In a small vial, $Mn(OAc)_3$ (27 mg, 0.10 mmol) and $H_3PO_4$ (0.84 mL of a 1.2 M aqueous solution, 1.0 mmol) were combined with aqueous NaOH (134 μL of a 5 M aqueous solution, 0.67 mmol). The final volume was adjusted to 1.5 mL by addition of deionized water, and then $H_2O_2$ (0.5 mL of a 30% aqueous solution, 4.4 mmol) was added. At this time, the pH of the solution was found to be 2.5. A 5×8 $mm^2$ poplar section was then immersed in the vial and the reaction monitored over a period of seven days. No fragmentation of the wood was observed.

Oxidation of Wood in $Na_2HPO_4$ Buffer, pH=6.5.

In a small vial, $Mn(OAc)_3$ (27 mg, 0.10 mmol) and $H_3PO_4$ (0.84 mL of a 1.2 M aqueous solution, 1.0 mmol) were combined with aqueous NaOH (280 μL of a 5 M aqueous solution, 1.4 mmol). The final volume was adjusted to 1.5 mL by addition of deionized water, and then $H_2O_2$ (0.5 mL of a 30% aqueous solution, 4.4 mmol) was added, resulting in significant bubbling. At this time, the pH of the solution was found to be 6.5. A 5×8 $mm^2$ poplar section was then immersed in the vial and the reaction monitored over a period of seven days. No fragmentation of the wood was observed.

In conclusion, an aqueous solution of manganese acetate an hydrogen peroxide showed a remarkable activity for the delignification of wood at room temperature. The mild, inexpensive process may be used to facilitate biofuel production by efficient removal of lignin.

Although the present invention has been described with reference to specific details, it is not intended that such details should be regarded as limitations upon the scope of the invention, except as and to the extent that they are included in the accompanying claims. For example, instead of manganese (III) acetate, manganese (II) acetate in an acetate buffered solution has also been shown to decompose lignin from lignocellulosic biomass. Manganese trifluoroacetate and manganese triflate (i.e. trifluorosulfonate) are also expected to decompose lignin from lignocellulosic biomass. Reaction times of a week or less for the decomposition of the lignin are within the scope of this invention.

What is claimed is:

1. A process for treating lignocellulosic biomass, comprising providing lignocellulosic biomass that includes lignin, forming either a suspension or a first aqueous solution by suspending or dissolving a solid manganese (III) salt selected from manganese (III) acetate, manganese(III) trifluoroacetate, or manganese (III) triflate in an aqueous solvent, combining an aqueous solution of hydrogen peroxide with the suspension or first aqueous solution to form a second aqueous solution, said second aqueous solution comprising a pH of less than about 6, and combining the second aqueous solution with the lignocellulosic biomass under conditions suitable for the decomposition of the lignin, thereby treating the lignocellulosic biomass.

2. The process of claim 1, wherein the suitable conditions include the lignocellulosic biomass and the second solution are at ambient temperature.

3. The process of claim 1, wherein the pH of said second aqueous solution is from about 3.0 to about 5.5.

4. The process of claim 1, wherein the first aqueous solution further comprises additional acetate as a buffer.

5. The process of claim 1, wherein the lignocellulosic biomass comprises non-food agricultural waste material.

6. The process of claim 1, wherein the non-food agricultural waste material comprises wood, corn stover, plant residues, grain husks, and mixtures thereof.

7. The process of claim 1, wherein the step of combining the aqueous hydrogen peroxide solution with the first aqueous solution to form the second aqueous solution comprises dropwise addition of the aqueous hydrogen peroxide solution to the first solution to form the second solution.

8. The process of claim 1, wherein said suitable conditions for the decomposition of the lignin comprise a temperature from about ambient temperature to about 150° C.

9. The process of claim 1, wherein suitable conditions for the decomposition of the lignin comprises a decomposition time of a week or less.

10. The process of claim 1, wherein the concentration of hydrogen peroxide in the second solution is less than about 30% peroxide aqueous hydrogen peroxide.

11. The process of claim 1, wherein the concentration of the manganese salt is up to about 2 molar.

12. The process of claim 1, wherein the lignocellulosic biomass comprises switchgrass.

* * * * *